United States Patent [19]

Kingsley

[11] 4,419,007

[45] Dec. 6, 1983

[54] MULTI-MODE DOCUMENT HANDLING SYSTEM

[75] Inventor: William Kingsley, Rochester, N.Y.

[73] Assignee: Xerox Corporation, Stamford, Conn.

[21] Appl. No.: 388,761

[22] Filed: Jun. 14, 1982

[51] Int. Cl.[3] ..... G03G 15/00

[52] U.S. Cl. ..... 355/14 SH; 271/DIG. 9; 271/186; 271/3.1; 355/23; 355/26

[58] Field of Search ..... 355/14 SH, 3 SH, 24, 355/23, 26; 271/3.1, DIG. 9, 65, 186, 4

[56] References Cited

U.S. PATENT DOCUMENTS

| | | | |
|---|---|---|---|
| 4,093,372 | 6/1978 | Guenther | 271/3.1 X |
| 4,158,500 | 6/1979 | DiFrancesco et al. | 271/3.1 X |
| 4,234,180 | 11/1980 | Looney | 271/3.1 |
| 4,264,067 | 4/1981 | Adams et al. | 271/DIG. 9 |
| 4,278,344 | 7/1981 | Sahay | 271/3.1 X |
| 4,330,197 | 5/1982 | Smith et al. | 355/26 X |
| 4,365,889 | 12/1982 | Silverberg | 355/14 SH |

*Primary Examiner*—R. L. Moses

*Attorney, Agent, or Firm*—Frederick E. McMullen

[57] ABSTRACT

An automatic document handling system particularly suitable for raster input scanners which is capable of operating in either a simplex or duplex document handling mode. The document handling system has document input and output trays in operative relation with a reversible document transport roll which in turn cooperates with a pair of displaceable pinch bars to provide both a document feeding nip and means for selectively routing the document for either duplex and simplex processing. A document guide having an integral control gate effects inverting and recirculation of the document for duplex mode or in simplex mode return of the document to the document supply tray.

7 Claims, 5 Drawing Figures

10
12
15
16
18
19
20
21
22
23
26
29
32
35
38
39
40
41
43
50
52
55
56
58
59
61
62
63
64
65
66
67
68
71
72
73
74
75
80
81
92
97

MULTI-MODE DOCUMENT HANDLING SYSTEM

The invention relates to a document handling system and more particularly to a document handling system designed to selectively permit either simplex or duplex scanning operation.

Automatic document handling devices are used in conjunction with printing machines such as copiers to automatically and without operator intervention bring documents to be copied one by one into predetermined position on the printing machine viewing platen. There, the document is exposed as for example by scanning or full frame flash, and the image rays representing the document image transmitted via the machine optical system to the printer imaging member, which may comprise a photoconductive web, for subsequent developing and transfer to the copy substrate material, as for example, a sheet of paper. Following exposure, the document handler removes the document to clear the platen for the next document, the document normally being returned to the document supply tray for removal, or in the case where the document handler is relied on to provide a precollated input, for refeeding. Concurrent with clearing of the platen, the next succeeding document is brought forward for exposure.

In cases where it is desired to reproduce both sides of the document, the document handler must incorporate some means for inverting and returning the document to the platen if automatic document handling is to be achieved. If not, the operator must, following exposure of one document side, intervene and manually turn the document or documents over, following which a second refeeding is required. Because of the demand placed upon document handlers, particularly where automatic handling of the documents for duplexing purposes is desired, automatic document handlers are normally complex and expensive, and are particularly subject to jams and document damage due to the complex document transport paths required to accomplish the difficult document movements and dispositions required.

The invention provides a duplex, single roll, single pass document handling system having a reversible document transport roll; a pair of base members below the transport roll spaced apart to form a scan slit; each base member being pivotally mounted to swing toward and away from the transport roll; a selector track which for simplex routes the document to a discharge tray or for a duplex back to the transport roll; and control means for setting the base members so that the downstream one of the base members is below the upstream one of the base members when simplex is desired and when duplex is desired, vice versa.

IN THE DRAWING

Figure 1:
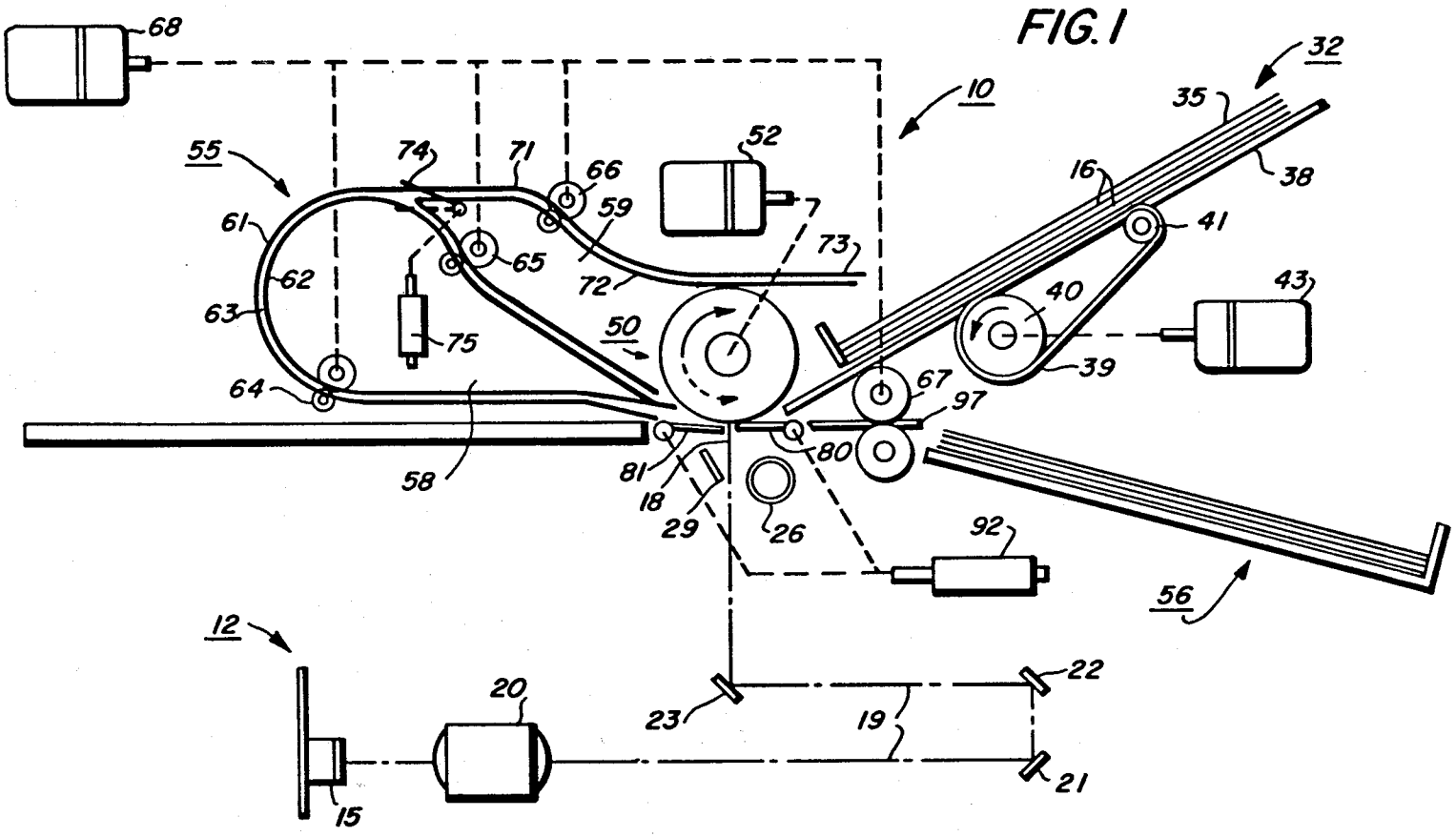
FIG. 1 is a schematic view of a raster input scanner incorporating the improved automatic document handling system of the present invention.
Figure 3A:
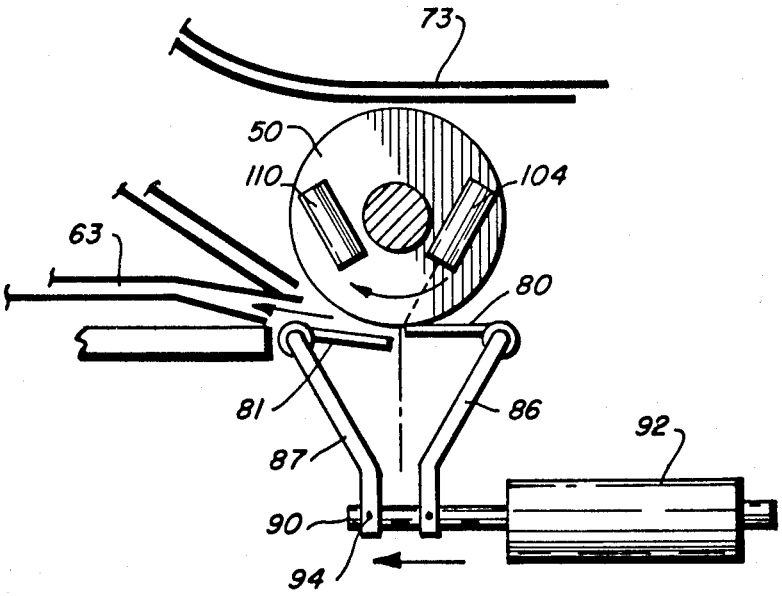
Figure 3B:
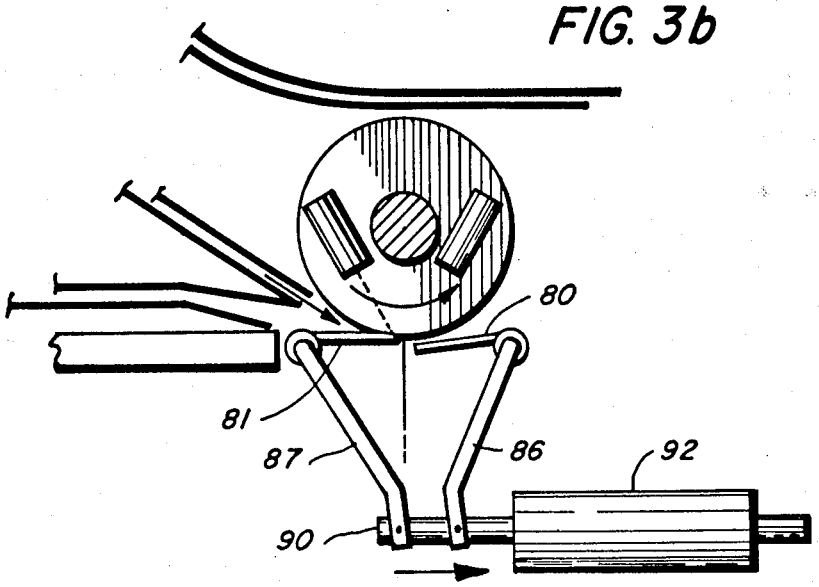
Figure 4:
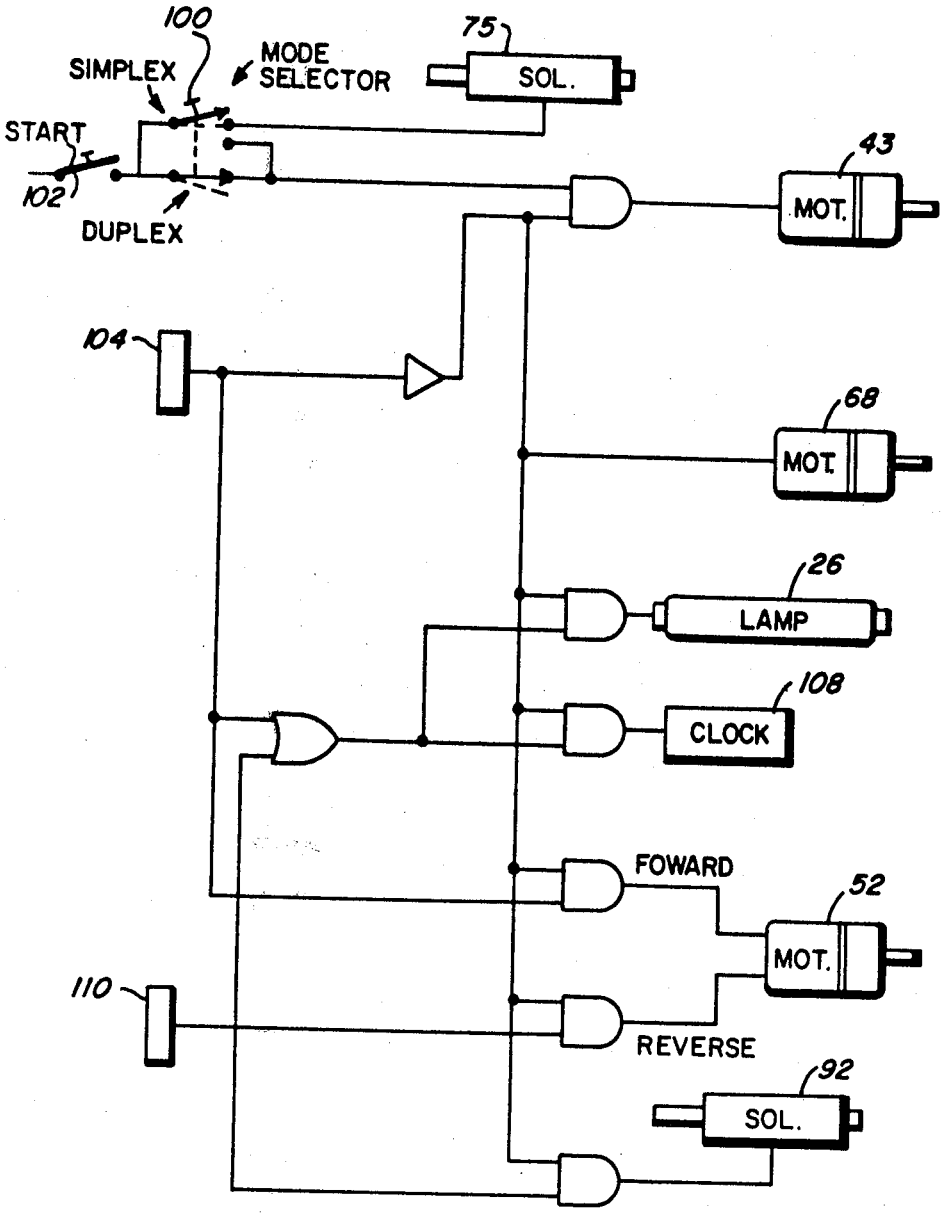

FIGS. 3*a* and 3*b* are schematic views illustrating simplex and duplex settings for the document handling system shown in FIG. 1; and FIG. 4 is a logic schematic of the control system used with the document handling system of the present invention.

Referring to FIG. 1 of the drawings, the duplex single roll, single pass document handling system of the present invention, designated generally by the number 10, is thereshown. Document handling system 10 is adapted to serve for example as a means for feeding original documents 16 across the slit-like scanning area 18 of a raster input scanner 12 where the document is scanned and the document image converted to electrical signals or pixels. For this purpose, raster input scanner 12 has one or more linear arrays 15 which may for example comprise a Model No. 1728 linear array manufactured and sold by Fairchild Corporation. Array 15 is disposed so as to scan in line by line fashion a document original 16 as the document is fed or moved across the slit-like scanning area 18 by the document handling system 10. A suitable clock 108 (shown in FIG. 4) is provided for operating array 15 in a manner known to those skilled in the art. A suitable optical path 19 shown here as lens 20 and mirrors 21, 22, 23, serves to focus the scanning area 18 and the line-like portion of the document being viewed onto the array 15.

To illuminate the scanning area 18 and the portion of the document 16 thereover, a suitable lamp 26 is provided, lamp 26 being situated in predetermined spaced relationship to the scanning area 18 and disposed on one side of the optical path 19. A suitable reflector 29 cooperates with lamp 26 to concentrate the light rays emitted by lamp 26 onto the scanning area 18.

Document handling system 10 includes a suitable document supply tray 32 on one side of the scanning area 18, tray 32 being upwardly inclined to facilitate feeding of the documents 16 therefrom. As will be understood the dimensions of the various components such as tray 32 are sufficient to accommodate the largest document to be processed.

To control feeding of documents 16 from a stack 35 of documents in tray 32, a suitable gate 37 is provided at the discharge end of tray 32, gate 37 being spaced slightly above the base 38 of tray 32 to restrict discharge of documents from tray 32 to one at a time. A document feeder in the form of feed belt 39 stretched across drive and idler rolls 40, 41 is disposed in operative relation with base 38 of document tray 32, a suitable aperture (not shown) being provided in base 38 to permit the upper surface of feed belt 39 to contact and engage the bottommost one of the documents in document tray 32. Drive roll 40 is drivingly coupled to a suitable driver shown here as document feed motor 43, motor 43 serving when actuated to rotate roll 40 and move feed belt 39 in the direction indicated by the solid line arrows when feeding a document forward from tray 32 to the scanning area 18.

To support and guide the document being fed from tray 32 into operative relationship with the scanning area 18, base 38 of document tray 32 is extended at 38' into proximity with the scanning area 18.

To move the document 16 across scanning area 18 during scanning thereof, a document feed roll 50 is disposed adjacent to scanning area 18 and as will appear more fully hereinafter, in predetermined spaced relationship to movable elements or pinch bars 80,81. Feed roll 50 is supported for reversible rotation by suitable bearing means (not shown), roll 50 being operatively coupled to a suitable reversible driver such as servo scan motor 52. Motor 52 when energized rotates document feed roll 50 in either the forward direction shown by the solid line arrow or the reverse direction shown by the dotted line arrow to move the document being scanned past the scanning area 18.

A simplex/duplex document guiding apparatus 55 is disposed downstream of the scanning area 18. As will appear, guide apparatus 55 receives the document as the document leaves the scanning area 18 following scanning of one side of the document and either guides the document back to the scanning area 18 for scanning of the other side of the document when in the Duplex Mode or returns the document to the top of any document 16 in tray 32 when in the Simplex Mode. When in the Duplex Mode, the documents are deposited in output tray 56 following scanning of the document opposite or second side.

Guide apparatus 55 is composed of a document inverting section 58 and document return section 59. The document inverting section 58 has a pair of spaced generally U-shaped guide members 61, 62 which cooperate to form therebetween a document inverting path 63 to invert the document moving therethrough and returned to scan area 18 for scanning of the document opposite side when in Duplex Mode. To sustain movement of the document along the inverting path 63 to scanning area 18, suitable feeding devices shown here as pinch roll pairs 64, 65, are provided at predetermined spaced points along the path 63. A suitable guide 97 with cooperating pinch roll pair 67 is provided on the downstream side of scanning area 18 to move the document to output tray 56. Pinch roll pairs 64, 65, 67 are driven in the direction shown by the solid line arrow by a suitable driver shown here as transport motor 68. It is understood that suitable apertures, (not shown) may be provided in the guide members 61, 62, and guide 97 to accommodate pinch roll pairs 64, 65, 67. And while three pinch roll pairs 64, 65, 67 are illustrated, a reduced or additional number of pinch roll pairs may be provided as required.

Document return section 59 has cooperating guide members 71, 72 coupled to guide member 61 of document inverting section 58 and pinch roll pair 66, guide members 71, 72 forming a document return path 73 communicating with document inverting path 63 to route documents in inverting path 63 back to the document supply tray 32 when operating in Simplex Mode. A swingable gate 74 is disposed at the juncture of document return section 59 with document inverting section 58, gate 74 when moved to the dotted line position shown being interposed astride the document inverting path 63 to intercept and divert the document therein into document return path 73. A suitable operator such as solenoid 75 serves when energized to move gate 74 from a non-intercepting (solid line) position to an intercepting (dotted line) position.

Figure 2:
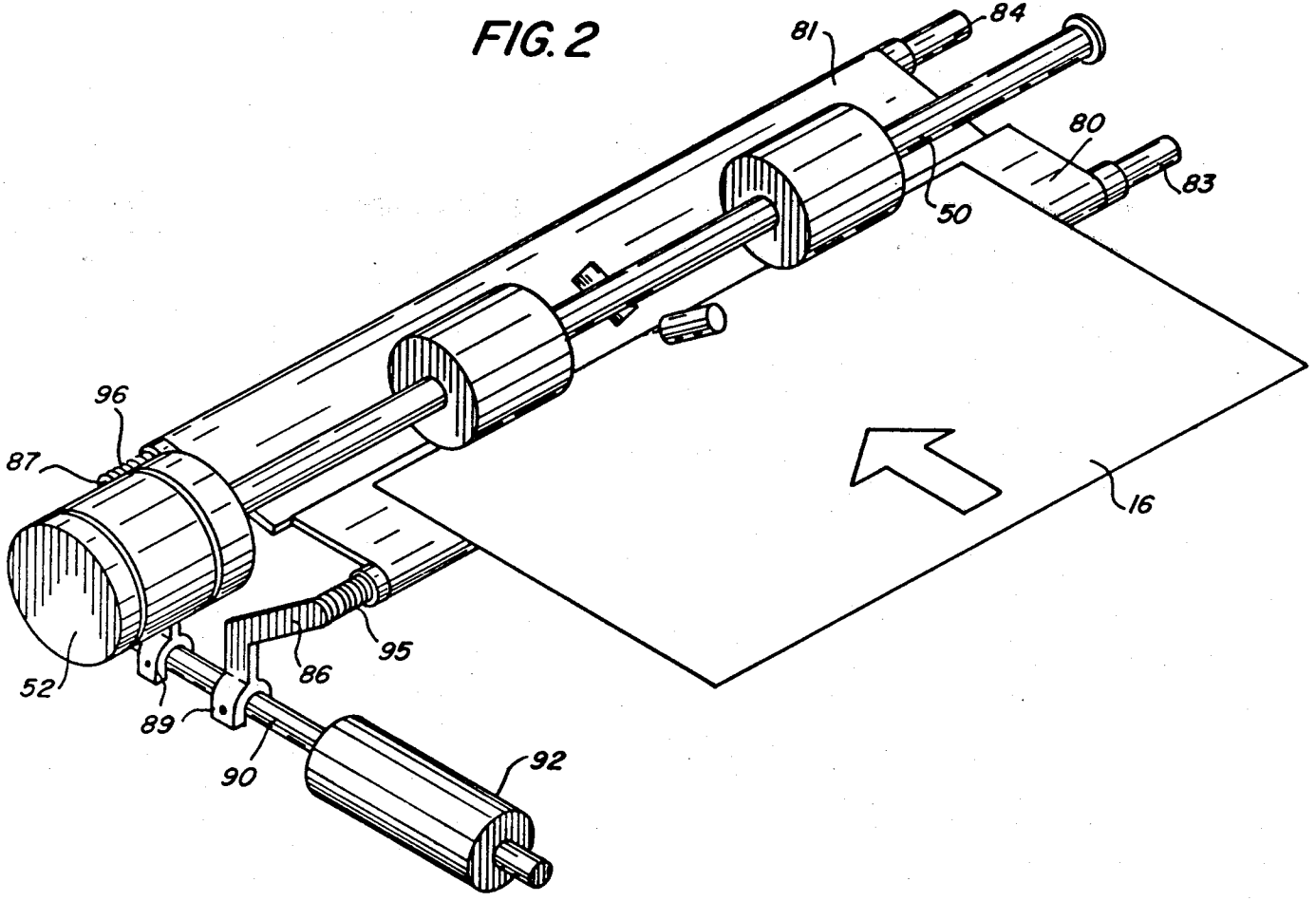
FIG. 2 is an isometric view showing details of the displaceable pinch bar arrangement used in the automatic document handling system shown in FIG. 1.

Referring particularly to FIGS. 1–3 of the drawings, to enable bi-directional movement of the document 16 in Duplex Mode while providing in cooperation with document feed roll 50, a nip for establishing and maintaining driving engagement between roll 50 and the document 16, movable pinch bars 80, 81 are provided. Bars 80, 81 each comprise a plate-like member supported at the end thereof opposite feed roll 50 by means of shafts 83, 84 respectively. Shafts 83, 84 are in turn rotatably supported by suitable bearing means (not shown) such that pinch bars 80, 81 may each swing between a raised position in which pinch bars 80, 81 cooperate with feed rolls 50 to form a nip for advancing the document being scanned, and a lowered position in which the pinch bars 80, 81 are separated from the feed roller 50. The dimension of pinch bars 80, 81 and the disposition of support shafts 83, 84 are chosen so that if pinch bars 80, 81 were simultaneously raised, the ends of bars 80, 81 would define the side edge boundaries of the slit-like scanning area 18. Each shaft 83, 84 has a depending actuator arm 86, 87 adjacent one end thereof, arms 86, 87 each having a slot-like opening 89 at the lower terminal end thereof through which drive shaft 90 of a suitable operator such as solenoid 92 extends. Actuator arms 86, 87 are drivingly connected to solenoid shaft 90 as by pins 94. Torsional springs 95, 96 bias each of the shafts 83, 84 and the pinch bar 80 or 81 thereof in a clockwise direction to bias pinch bar 80 in the raised position and pinch bar 81 in the lowered position shown in FIG. 3*a* of the drawings. As will be understood, energization of solenoid 92 depresses pinch bar 80 while raising pinch bar 82 as shown in FIG. 3*b*.

Referring particularly to FIG. 4 of the drawings, a suitable mode selector 100 is provided to enable the operator to select either duplex or simplex scan mode. Disposition of mode selector 100 in either the duplex or simplex mode settings readies document feeder motor 43, lamp 26, array clock 108, scan motor 52, transport motor 68, and pinch bar control solenoid 92 for operation. A pair of document edge detectors 104, 110 are provided adjacent each side of feed roll 50 to sense the presence or absence of the document being scanned. In order to maintain document feed motor 43 on for a sufficient time after the document lead edge is sensed by detector 104 for the document leading edge to reach the nip formed by feed roll 50 and pinch bar 80, a suitable timer 105 is provided. Timer 105 which is energized in response to sensing of the document leading edge by detector 104, tolls an interval during which feeder motor 43 is held energized and feed belt 39 operative to advance the document leading edge into the nip formed by feed roll 50 and pinch bar 80.

Start switch 102 serves to initate through mode selector 100 operation of the system. Mode selector switch 100, when disposed in the simplex mode, additionally readies gate solenoid 75 for energization, such energization taking place on closure of start switch 102.

OPERATION

At start-up, pinch bar 80 is biased upwardly to the raised position by spring 95 while pinch bar 81 is biased downwardly by spring 96 as seen in FIGS. 1, 2 and 3*a*. Where duplex scanning of a document original in tray 32 is desired, mode switch 100 is set to the Duplex Mode position. After loading of the document or documents to be scanned in the document tray 32, start button 102 is actuated. Actuation of start button 102 energizes transport motor 68 to drive pinch roll pairs 64, 65, 66, 67. Document feed motor 43 is also energized. Motor 43 drives document feed belt 39 in the direction shown by the solid line arrow to feed the document or in the case where more than one document is present in document tray 32 the bottommost document, forward past gate 37 and into the nip formed by the document feed roll 50 and the raised pinch bar 80. As the leading edge of the document passes detector 104, a signal from detector 104 energizes scan motor 52 to operate document feed roll 50 in the forward direction and advance the document across the scan area 18. At the same time, lamp 26 is energized to illuminate the document and clock 108 actuated to operate array 15.

As the document is moved across scanning area 18 by feed roll 50, the lead edge of the document strikes the surface of the depressed pinch bar 81 which serves to guide the document leading edge into the document inverting path 63 formed by guide members 61, 62 of document guiding apparatus 55. With continued scan of the document, the document leading edge advances along path 63 to pinch roll pairs 64, 65 in succession. Pinch roll pairs 64, 65 assist in moving the document along the path 63 and back toward scanning area 18. On passage of the trailing edge of the document past detector 104, a signal from detector 104 disables scan motor 52. At the same time lamp 26 is deenergized and clock 108 stopped to terminate operation of array 15.

Pinch roll pairs 64, 65, continue to transport the document along path 63, the document being inverted as the document moves along path 63. On the document leading edge reaching detector 110, a signal from detector 110 energizes scan motor 52 to operate document feed roll 50 in the reverse direction (the direction shown by the dotted line arrows). At the same time the signal from detector 110 energizes solenoid 92 to swing pinch bar 80 down while raising pinch bar 81 to the positions shown in FIG. 3*b*, the latter cooperating with feed roll 50 to form a nip for feeding of the document past scan slit 18. Lamp 26 and clock 108 are energized by the signal from detector 110, the latter to initiate scanning operation of the array 15.

As the leading edge of the document passes scanning area 18, the document edge is guided by pinch bar 80 onto guide 97 and into output tray 56. As the trailing edge of the document passes detector 110, the signal from detector 110 deenergizes lamp 26 and pixel clock 108, the latter terminating operation of array 15. At the same time, scan motor 52 and solenoid 92 are deenergized, the latter permitting pinch bars 80, 81 to resume their normal position. Motor 68 remains energized to maintain pinch roll pair 67 operative and assure return of the document to output tray 56. Resetting of start button 102 to the off position deenergizes motor 68 to terminate operation of pinch roll pairs 64, 65, 66, 67 and the system 10.

For simplex scanning, mode switch 100 is set to the Simplex Mode position to ready gate solenoid 75 for energization. On closure of start button 102, solenoid 75 is actuated to move gate 74 to the document intercepting position astride document inverting path 63. At the same time, feeding of a document to be scanned from tray 32 and into the nip formed by feed roll 50 and pinch bar 80 is commenced in the manner described heretofore. As the document is advanced across scanning area 18, the document is scanned line by line by array 15 with the leading edge of the document being guided into and passing along the inverting path 63 with the assistance of pinch roll pair 64. When the document leading edge reaches gate 74, gate 74 routes the document into simplex return path 73 which returns the document to the document support tray 32.

While the invention has been described in a raster scanning environment, other applications may be envisioned as for example a xerographic copier scan system wherein a document to be copied is illuminated line by line and the resulting image rays transmitted along an optical path to expose a previously charged xerographic member.

While the invention has been described with reference to the structure disclosed, it is not confined to the details set forth, but is intended to cover such modifications or changes as may come within the scope of the following claims.

What is claimed is:

1. A multi-mode document handling system selectively permitting either simplex mode scanning wherein a first side of a document is scanned or duplex mode scanning wherein both first and second sides of the document are scanned, said system including at least one scanning array and a slit-like viewing area through which said document is viewed by said array, the combination comprising:

(a) a document supply tray for supporting one or more documents to be scanned;

(b) document transport means for moving the document to be scanned from said tray and across said viewing area for scanning of said document first side by said array;

(c) mode selection means selectively operable to permit either simplex or duplex scanning of said document, said mode selection means including movable simplex and duplex pinch elements on each side of said viewing area, each of said pinch elements being adapted when moved to an operative position to cooperate with said document transport means to form a nip permitting said transport means to engage said document and move said document across said viewing area for scanning by said array; and (d) control means for selectively moving one or the other of said simplex and duplex pinch elements to said operative position to provide either simplex or duplex scanning of said document.

2. The system according to claim 1 including means forming a duplex path for inverting and returning said document to said viewing area for scanning of said document second side by said array.

3. The system according to claim 2 including means forming a simplex path for returning said document to said tray following scanning of said document first side by said array;

said mode selection means including gate means effective in a first position to route said document in said duplex path to said viewing area for scanning of said document second side by said array and in a second position to route said document in said simplex path for return to said tray;

said control means actuating said gate means selectively to provide either simplex or duplex scanning.

4. The system according to claim 1 in which said mode selection means includes:

drive means adapted when actuated to move said simplex pinch element from said operative position and said duplex pinch element to said operative position, said control means actuating said drive means in said duplex mode whereby to move said pinch elements and switch from simplex mode to duplex mode.

5. The system according to claim 1 in which said transport means includes at least one document feed roll in operative relation with said viewing area and said simplex and duplex pinch elements;

motor means for driving said feed roll to move said document across said viewing area for scanning of said document first side;

said control means including a first document sensor for actuating said motor means in response to the presence of said document at said viewing area;

said motor means being reversible to drive said feed roll in the reverse direction to move said document across said viewing area for scanning of said document second side in said duplex mode;

said control means including a second document sensor for actuating said motor means in reverse in response to the return of said document to said viewing area.

6. Apparatus permitting either simplex or duplex scanning of a document comprising in combination:

(a) a document supply tray;

(b) a document feed roll for transporting a document from said tray past a scan point;

(c) a first document guide on one side of said scan point to guide said document into driving contact with said feed roll whereby to enable said roll to engage and transport said document past said scan point;

(d) a document return path for selectively returning said document to said tray on simplex scanning or returning said document to said scan point for duplex scanning, said document return path having an inlet for said document downstream of said scan point; and (e) a second document guide on the side of said scan point opposite said first document guide for guiding said document to said document return path inlet.

7. The apparatus according to claim 6 including (a) a discharge tray for receiving said document following duplex scanning, said discharge tray having an inlet on the side of said scan point adjacent said first document guide;

(b) means for moving said second document guide to a position where said second document guides said document from said document return path into driving contact with said transport roll to enable said transport roll to engage and transport said document past said scan point;

(c) means for reversing said feed roll to transport said document past said scan point in the opposite direction for duplex scanning; and (d) means for moving said first guide to a position where said first guide guides said document to said discharge tray inlet during duplex scanning.

* * * * *